US011471349B2

(12) United States Patent
Stevens et al.

(10) Patent No.: US 11,471,349 B2
(45) Date of Patent: Oct. 18, 2022

(54) PATIENT LIFT SYSTEM

(71) Applicant: Liko Research & Development AB, Lulea (SE)

(72) Inventors: Kayla Stevens, Batesville, IN (US); Derek Strassle, Batesville, IN (US)

(73) Assignee: LIKO Research & Development AB, Lulea (SE)

( * ) Notice: Subject to any disclaimer, the term of this patent is extended or adjusted under 35 U.S.C. 154(b) by 520 days.

(21) Appl. No.: 16/566,319

(22) Filed: Sep. 10, 2019

(65) Prior Publication Data

US 2020/0085658 A1 Mar. 19, 2020

Related U.S. Application Data

(60) Provisional application No. 62/732,341, filed on Sep. 17, 2018.

(51) Int. Cl.
*A61G 7/10* (2006.01)
*A61G 7/14* (2006.01)

(52) U.S. Cl.
CPC ..... *A61G 7/1042* (2013.01); *A61G 7/1015* (2013.01); *A61G 2203/10* (2013.01); *A61G 2203/20* (2013.01); *A61G 2203/32* (2013.01)

(58) Field of Classification Search
CPC .... A61G 7/1042; A61G 7/104; A61G 7/1015; A61G 7/1013; A61G 2203/10; A61G 2203/32
USPC ..... 5/88.1, 83.1, 81.1 R
See application file for complete search history.

(56) References Cited

U.S. PATENT DOCUMENTS

| | | | | |
|---|---|---|---|---|
| 5,865,426 | A | 2/1999 | Kazerooni | |
| 6,386,513 | B1 | 5/2002 | Kazerooni | |
| 6,622,990 | B2 | 9/2003 | Kazerooni | |
| 6,886,812 | B2 | 5/2005 | Kazerooni | |
| D543,003 | S | 5/2007 | Helmetsie | |
| D543,334 | S | 5/2007 | Helmetsie | |
| 7,559,533 | B2 | 7/2009 | Stockmaster et al. | |
| 8,978,905 | B2 | 3/2015 | Bergenstråle | |
| 9,408,765 | B2 | 8/2016 | Andersson et al. | |
| 9,421,140 | B2 * | 8/2016 | Faucher | A61G 7/1015 |
| 9,463,128 | B2 | 10/2016 | Ng | |
| 9,925,107 | B2 | 3/2018 | Faucher et al. | |
| 10,376,434 | B2 * | 8/2019 | Andersson | A61G 7/1065 |

(Continued)

FOREIGN PATENT DOCUMENTS

| | | | |
|---|---|---|---|
| EP | 1065674 A2 | 1/2001 | |
| EP | 3622934 A1 * | 3/2020 | A61G 7/1015 |

(Continued)

*Primary Examiner* — Robert G Santos
(74) *Attorney, Agent, or Firm* — Price Heneveld LLP

(57) ABSTRACT

A patient lift system includes a motor and a drum. The drum is operably coupled to the motor. The drum can be selectively driven to rotate by the motor. A housing surrounds at least the motor and the drum. A load-bearing member is provided that includes a first end and a second end. The first end of the load-bearing member can be operably coupled to at least one of the housing and the drum. The second end of the load-bearing member can be operably coupled to a patient support assembly. An electrically conductive member can be positioned within the load-bearing member. A user interface is configured to actuate the patient support assembly in vertical and horizontal directions.

16 Claims, 8 Drawing Sheets

(56) References Cited

U.S. PATENT DOCUMENTS

| | | | | |
|---|---|---|---|---|
| 10,918,549 | B2 * | 2/2021 | Andersson | G01G 19/52 |
| 11,191,688 | B2 * | 12/2021 | Yeckel | A61G 7/1065 |
| 2013/0019401 | A1 | 1/2013 | Faucher et al. | |
| 2014/0013503 | A1 | 1/2014 | Dixon et al. | |
| 2017/0027794 | A1 | 2/2017 | Andersson et al. | |
| 2017/0065475 | A1 * | 3/2017 | Faucher | A61G 7/1034 |
| 2019/0231623 | A1 * | 8/2019 | Yeckel | A61G 7/1065 |
| 2019/0314234 | A1 * | 10/2019 | Andersson | A61G 7/1051 |
| 2020/0085658 | A1 * | 3/2020 | Stevens | A61G 7/1042 |
| 2022/0133566 | A1 * | 5/2022 | Monson | A61G 7/1017<br>5/83.1 |

FOREIGN PATENT DOCUMENTS

| | | | | |
|---|---|---|---|---|
| EP | 3622934 | B1 * | 5/2021 | A61G 7/1015 |
| WO | 2018201232 | A1 | 11/2018 | |

* cited by examiner

PATIENT LIFT SYSTEM

CROSS-REFERENCE TO RELATED APPLICATION

This application claims priority to U.S. Provisional Patent Application No. 62/732,341, filed Sep. 17, 2018, entitled "Patient Lift System," the disclosure of which is hereby incorporated herein by reference in its entirety.

FIELD OF THE DISCLOSURE

The present disclosure generally relates to lift systems. More specifically, the present disclosure relates to patient lift systems.

BACKGROUND

In various environments, caregivers may need to move patients from one location to another. Often, the patients are unable to move by their own volition due to injuries, illness, weight, or other factors. Accordingly, caregivers may need to aid the patient in their movements. Therefore, lift systems have been developed to aid the caregivers with the movement of patients that are unable to move by their own volition. While various lift systems have been developed, there is still room for improvement. Thus, a need persists for further development of patient lift systems.

SUMMARY

According to a first aspect of the present disclosure, a patient lift system includes a motor and a drum. The drum is operably coupled to the motor. The drum can be selectively driven to rotate by the motor. A housing surrounds at least the motor and the drum. A load-bearing member includes a first end and a second end. The first end of the load-bearing member is operably coupled to at least one of the housing and the drum. The second end of the load-bearing member is operably coupled to a patient support assembly. The load-bearing member includes an inner diameter and an outer diameter. The inner diameter defines an aperture that extends along an entirety of a length of the load-bearing member. An electrically conductive member is positioned within the aperture defined by the inner diameter of the load-bearing member. A user interface is configured to actuate the patient support assembly in vertical and horizontal directions.

According to various examples of the first aspect of the present disclosure, the load-bearing member can be directly and statically coupled to the housing such that the electrically conductive member passes through the load-bearing member as the electrically conductive member is wound and unwound from the drum. Alternatively, the load-bearing member can be directly coupled to the drum such that the load-bearing member and the electrically conductive member are wound and unwound from the drum as the patient support assembly is extended and retracted relative to the housing. In some examples, the user interface includes a button, and upon actuation of the button on the user interface, actuation of the patient support assembly in the horizontal direction is initiated. A force sensor can be provided that is configured to sense a magnitude of force applied in at least one of the vertical direction and the horizontal direction. The sensed magnitude of force can be converted into corresponding translational motion of the patient support assembly in at least one of the vertical direction and the horizontal direction. In various examples, the force sensor can be coupled to the user interface. In some examples, the user interface includes a hand-actuated control assembly. A carriage can be provided that extends from the housing to slidably couple the patient lift system to a rail. The rail can guide the patient lift system during actuation of the patient support assembly in the horizontal direction. The above examples may be incorporated in combination or in isolation with the first aspect of the present disclosure.

According to a second aspect of the present disclosure, a patient lift system includes a motor and a drum. The drum is operably coupled to the motor. The drum can be selectively driven to rotate by the motor. A housing surrounds at least the motor and the drum. A load-bearing member includes a first end and a second end. The first end of the load-bearing member is operably coupled to at least one of the housing and the drum. The second end of the load-bearing member is operably coupled to a patient support assembly. The load-bearing member is a woven textile. An electrically conductive member is integrally woven with the load-bearing member. A user interface is configured to actuate the patient support assembly in vertical and horizontal directions.

According to various examples of the second aspect of the present disclosure, the load-bearing member can be directly and statically coupled to the housing such that the electrically conductive member passes through the load-bearing member as the electrically conductive member is wound and unwound from the drum. Alternatively, the load-bearing member can be directly coupled to the drum such that the load-bearing member and the electrically conductive member are wound and unwound from the drum as the patient support assembly is extended and retracted relative to the housing. The user interface includes a button, and upon actuation of the button on the user interface, actuation of the patient support assembly in the horizontal direction is initiated. A force sensor can be provided that is configured to sense a magnitude of force applied in at least one of the vertical direction and the horizontal direction. The sensed magnitude of force is converted into corresponding translational motion of the patient support assembly in at least one of the vertical direction and the horizontal direction. The force sensor can be coupled to the user interface. The user interface can include a hand-actuated control assembly. A carriage can be provided that extends from the housing to slidably couple the patient lift system to a rail. The rail can guide the patient lift system during actuation of the patient support assembly in the horizontal direction. The above examples may be incorporated in combination or in isolation with the second aspect of the present disclosure.

According to a third aspect of the present disclosure, a patient lift system includes a motor and a drum. The drum is operably coupled to the motor. The drum can be selectively driven to rotate by the motor. A housing surrounds at least the motor and the drum. A load-bearing member includes a first end and a second end. The first end of the load-bearing member can be operably coupled to at least one of the housing and the drum. The second end of the load-bearing member can be operably coupled to a patient support assembly. An electrically conductive member extends along a length of the load-bearing member. A user interface is configured to actuate the patient support assembly in vertical and horizontal directions. The user interface includes a force sensor configured to sense a magnitude of force applied in at least one of the vertical direction and the horizontal direction. The sensed magnitude of force is converted into corresponding translational motion of the patient support assembly in at least one of the vertical direction and the horizontal direction.

According to various examples of the third aspect of the present disclosure, the patient lift system can further include a carriage that extends from the housing to slidably couple the patient lift system to a rail. The rail can guide the patient lift system during actuation of the patient support assembly in the horizontal direction.

These and other aspects, objects, and features of the present disclosure will be understood and appreciated by those skilled in the art upon studying the following specification, claims, and appended drawings.

DETAILED DESCRIPTION

Figure 1:
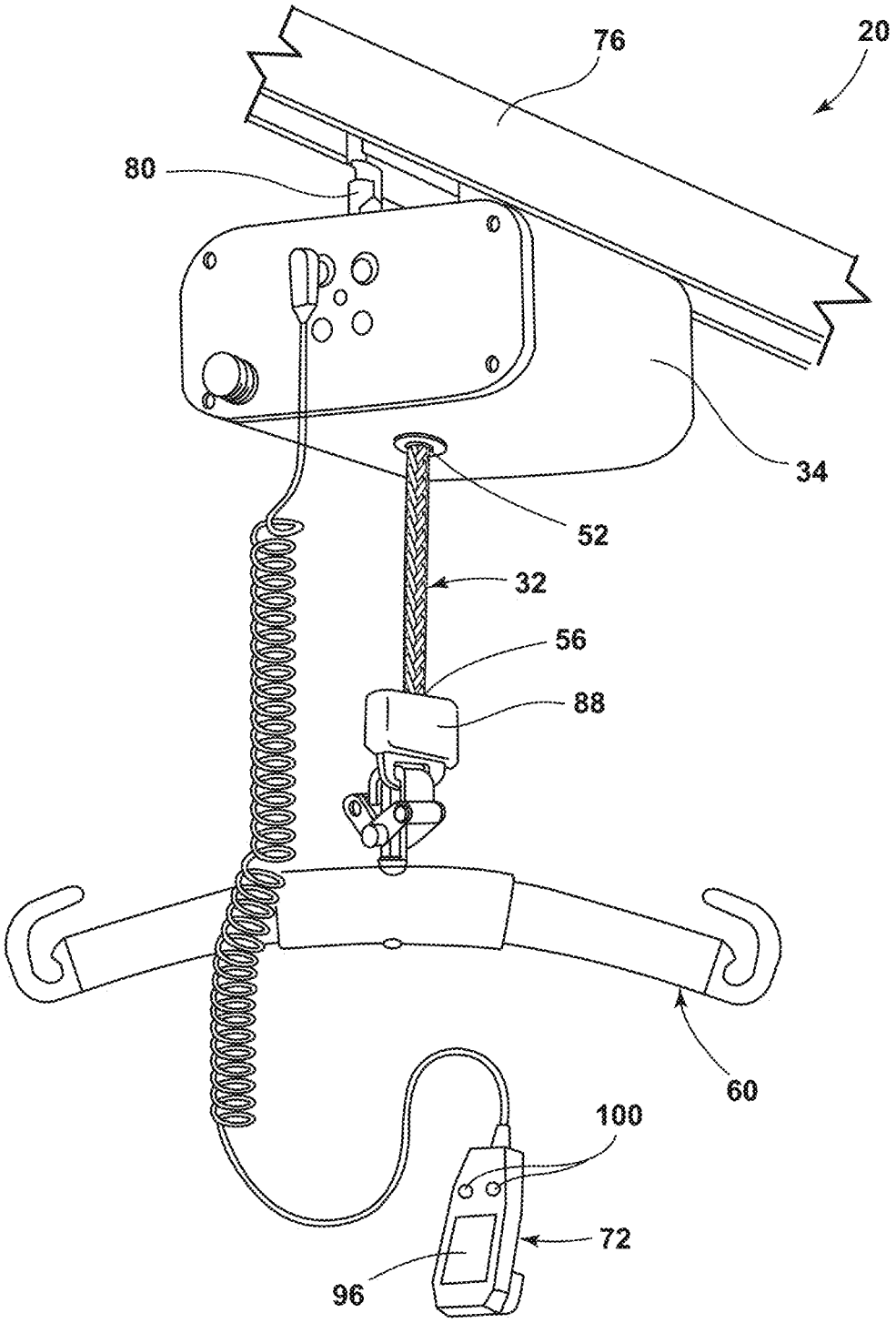
FIG. 1 is a perspective view of an exemplary rail-mounted patient lift system, illustrating an example of a user interface.
Figure 2:
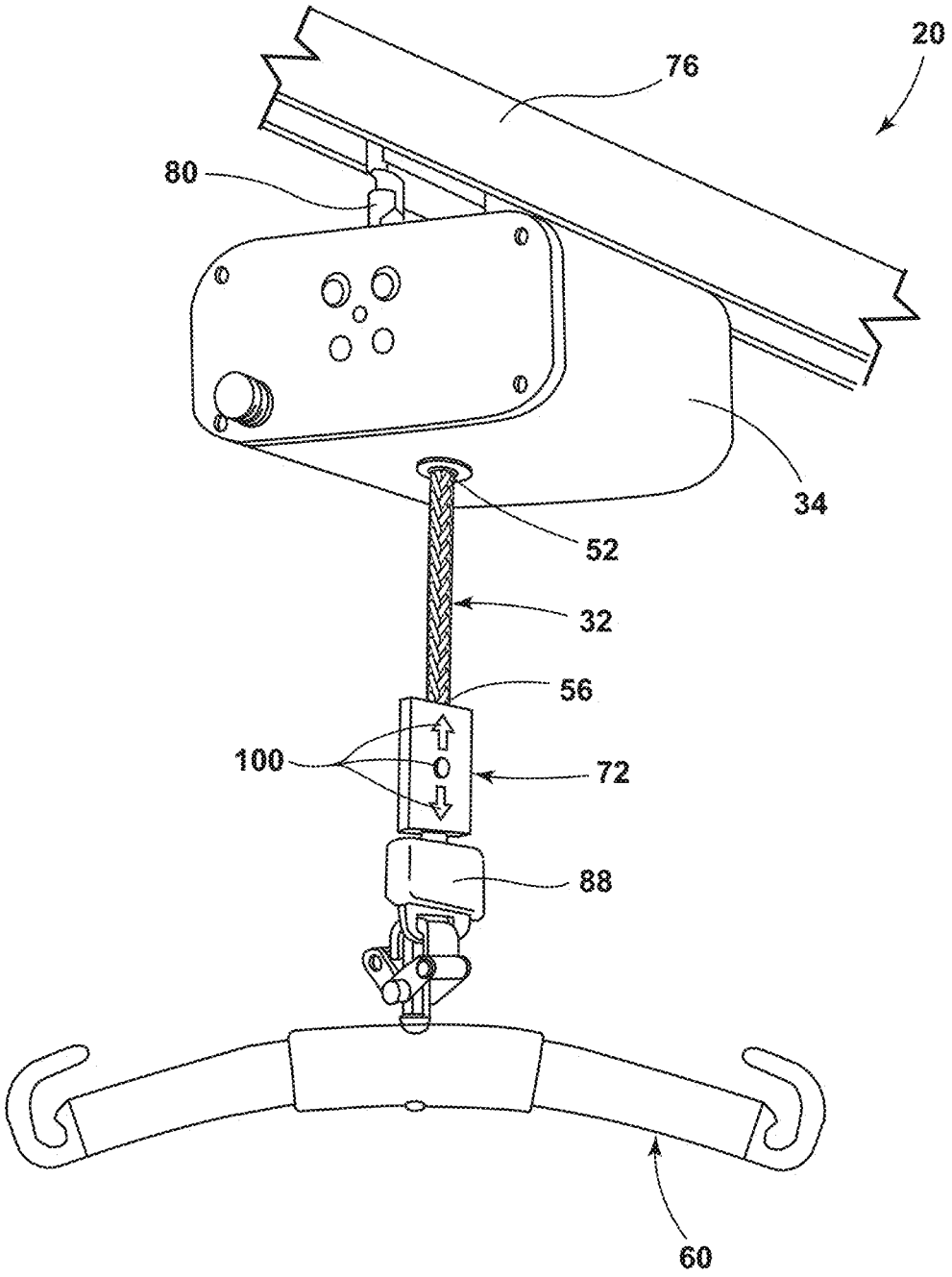
FIG. 2 is a perspective view of an exemplary rail-mounted patient lift system, illustrating an alternative example of the user interface.

For purposes of description herein, the terms "upper," "lower," "right," "left," "rear," "front," "vertical," "horizontal," and derivatives thereof shall relate to the concepts as oriented in FIG. 1. However, it is to be understood that the concepts may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The present illustrated embodiments reside primarily in combinations of method steps and apparatus components related to a patient lift system. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

As used herein, the term "and/or," when used in a list of two or more items, means that any one of the listed items can be employed by itself, or any combination of two or more of the listed items, can be employed. For example, if a composition is described as containing components A, B, and/or C, the composition can contain A alone; B alone; C alone; A and B in combination; A and C in combination; B and C in combination; or A, B, and C in combination.

In this document, relational terms, such as first and second, top and bottom, and the like, are used solely to distinguish one entity or action from another entity or action, without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

As used herein, the term "about" means that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. When the term "about" is used in describing a value or an end-point of a range, the disclosure should be understood to include the specific value or end-point referred to. Whether or not a numerical value or end-point of a range in the specification recites "about," the numerical value or end-point of a range is intended to include two embodiments: one modified by "about," and one not modified by "about." It will be further understood that the end-points of each of the ranges are significant both in relation to the other end-point, and independently of the other end-point.

The terms "substantial," "substantially," and variations thereof as used herein are intended to note that a described feature is equal or approximately equal to a value or description. For example, a "substantially planar" surface is intended to denote a surface that is planar or approximately planar. Moreover, "substantially" is intended to denote that two values are equal or approximately equal. In some embodiments, "substantially" may denote values within about 10% of each other, such as within about 5% of each other, or within about 2% of each other.

As used herein the terms "the," "a," or "an," mean "at least one," and should not be limited to "only one" unless explicitly indicated to the contrary. Thus, for example, reference to "a component" includes embodiments having two or more such components unless the context clearly indicates otherwise.

Referring to FIGS. 1-7, reference numeral 20 generally designates a patient lift system. The patient lift system 20 includes a motor 24 and a drum 28 operably coupled to the motor 24. The drum 28 is configured to be selectively driven by the motor 24 to rotate in one of a clockwise direction and a counter-clockwise direction. In some examples, one of the clockwise rotation and the counter-clockwise rotation of the drum 28 can effect an extension of a load-bearing member 32 that is coupled to the drum 28 while the other of the clockwise rotation and the counter-clockwise rotation of the drum 28 can effect a retraction of the load-bearing member 32. In alternative examples, the load-bearing member 32 can be coupled to a housing 34 that surrounds at least the motor 24 and the drum 28. In some examples, the load-bearing member 32 includes an inner diameter 36 and an outer diameter 40. The inner diameter 36 of the load-bearing member 32 defines an aperture 44 that extends along an entirety of a length 48 of the load-bearing member 32. A first end 52 of the load-bearing member 32 is operably coupled to at least one of the housing 34 and the drum 28. A second end 56 of the load-bearing member 32 is operably coupled to a patient support assembly 60. In some examples, the patient lift system 20 includes one or more electrically conductive members 64 that are positioned within the aperture 44 that is defined by the inner diameter 36 of the load-bearing member 32. In examples, the first end 52 of the load-bearing member 32 can be directly and statically coupled to the housing 34 such that the one or more electrically conductive members 64 pass through the load-bearing member 32 as the one or more electrically conductive members 64 are wound and unwound from the drum 28. In such examples, the load-bearing member 32 may be wound and unwound from a separate structure within the patient lift system 20. For example, the load-bearing member 32 may be wound and unwound from the second end 56 while the one or more electrically conductive members 64 are wound and unwound from the first end 52. In alternate examples, the load-bearing member 32 is directly coupled to the drum 28 such that the load-bearing member 32 and the one or more electrically conductive members 64 are wound and unwound from the drum 28 as the patient support assembly 60 is extended and retracted relative to the housing 34. The one or more electrically conductive members 64 can have a length 68 that is greater than the length 48 of the load-bearing member 32. The one or more electrically conductive members 64 can include one or more of a power cable, a data cable, and a wear-and-tear indication cable. In various examples, the patient lift system 20 further includes a user interface 72 that is configured to actuate the patient support assembly 60 in vertical and horizontal directions.

Referring again to FIGS. 1-4, the patient lift system 20 is depicted in exemplary fashion according to various examples of the user interface 72. The patient lift system 20 is configured to lift and/or move a patient from one location to another. For example, the patient lift system 20 can be utilized when transitioning a patient to or from a bed, a wheel chair, a lift-supported suspended position, and/or a lift-supported standing position. The patient lift system 20 can be slidably coupled to one or more rails 76 that are secured or coupled to a support surface, such as a ceiling of a room. Alternatively, the patient lift system 20 can be coupled to an upper portion of a mobile lift or lift cart. The slidable coupling of the patient lift system 20 to the one or more rails 76 can be accomplished by a carriage 80 that extends above the housing 34 of the patient lift system 20 to the rail 76. In the depicted examples, the patient lift system 20 is configured to support and/or lift a patient with the load-bearing member 32 by way of the patient support assembly 60. The patient support assembly 60 may be a sling bar, a sling, a harness, a vest, a sheet, a stretcher, a transfer aid, a transfer board, or any other suitable patient support accessory, including combinations thereof. In general, the patient support assembly 60 is configured to facilitate a lifting and/or transport movement of the patient. The lifting and/or transport movement of the patient is aided or enabled by a movement system 92 that is contained within the housing 34 and will be discussed in further detail below. An exemplary movement system 92 is disclosed in U.S. Pat. No. 9,408,765, entitled LIFT SYSTEM WITH LOWERING MECHANISM, which is incorporated herein by reference in its entirety. The patient support assembly 60 engages with the second end 56 of the load-bearing member 32. For example, the patient support assembly 60 can engage with a coupler 88 that is provided at the second end 56 of the load-bearing member 32. In some examples, the user interface 72 can be positioned between the second end 56 of the load-bearing member 32 and the coupler 88. By so positioning the user interface 72 (see FIGS. 2-4), a caregiver may maintain the ability to interact with the user interface 72 while caring for the patient and at the same time is unencumbered by a tethered control that extends from the housing 34, as shown in the example of FIG. 1. In examples where the user interface 72 is a tethered control, portions of the tethered control (e.g., power cable) can contact the patient while the caregiver is transitioning the patient to or from the patient support assembly 60 and while the patient is being moved by the patient lift system 20. Such contact between the patient and the tethered control can lead to discomfort, irritation, and a decrease in the quality of the patient's experience.

Referring further to FIGS. 1-4, the user interface 72 can include a display screen 96 and/or one or more buttons 100. In examples where the display screen 96 and the one or more buttons 100 are provided, the display screen 96 may present the user with various options, operations, or statuses that can be navigated between and/or selected by the one or more buttons 100. In some examples where the one or more buttons 100 are provided but the display screen 96 is omitted, the one or more buttons 100 may be utilized to accomplish raising the patient support assembly 60, lowering the patient support assembly 60, stopping the movement of the patient support assembly 60, actuating the patient support assembly 60 in a horizontal direction, transitioning controls between horizontal and vertical movement, rotating the patient support assembly 60 about a vertical axis, and/or combinations thereof. Transitioning between horizontal and vertical movement of the patient support assembly 60 can be accomplished, in one example, by actuating a toggle switch (e.g., the central button in FIG. 2) such that the buttons 100 that were associated with raising and lowering the patient support assembly 60 can then be associated with lateral or horizontal actuation of the patient support assembly 60. In some examples, the one or more buttons 100 may be omitted and the display screen 96 may be provided as a touchscreen. In such examples, the touchscreen can be utilized to select and navigate through various options, operations, and/or statuses, including vertical and horizontal actuation of the patient support assembly 60.

Figure 3:
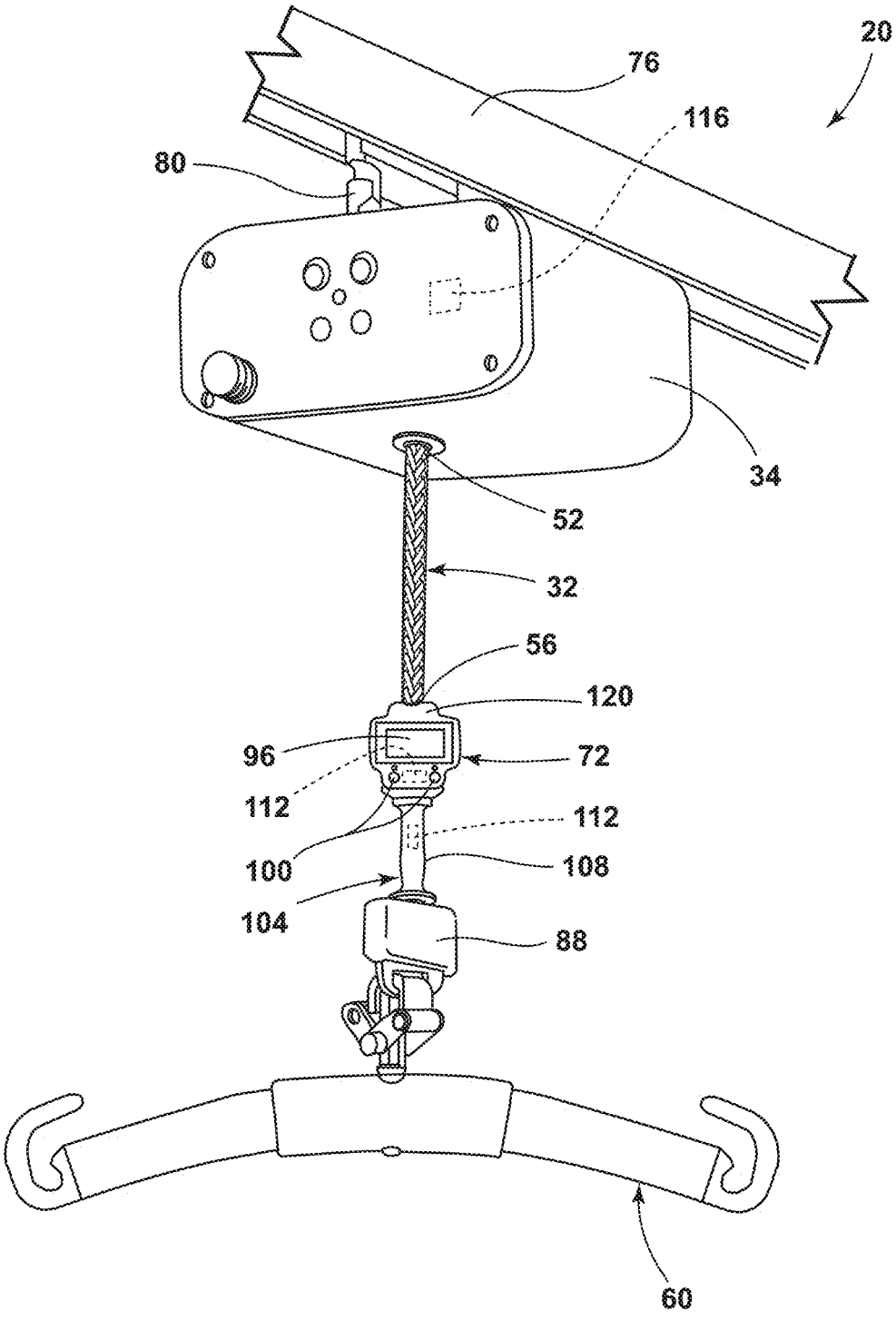
FIG. 3 is a perspective view of an exemplary rail-mounted patient lift system, illustrating another example of the user interface.
Figure 4:
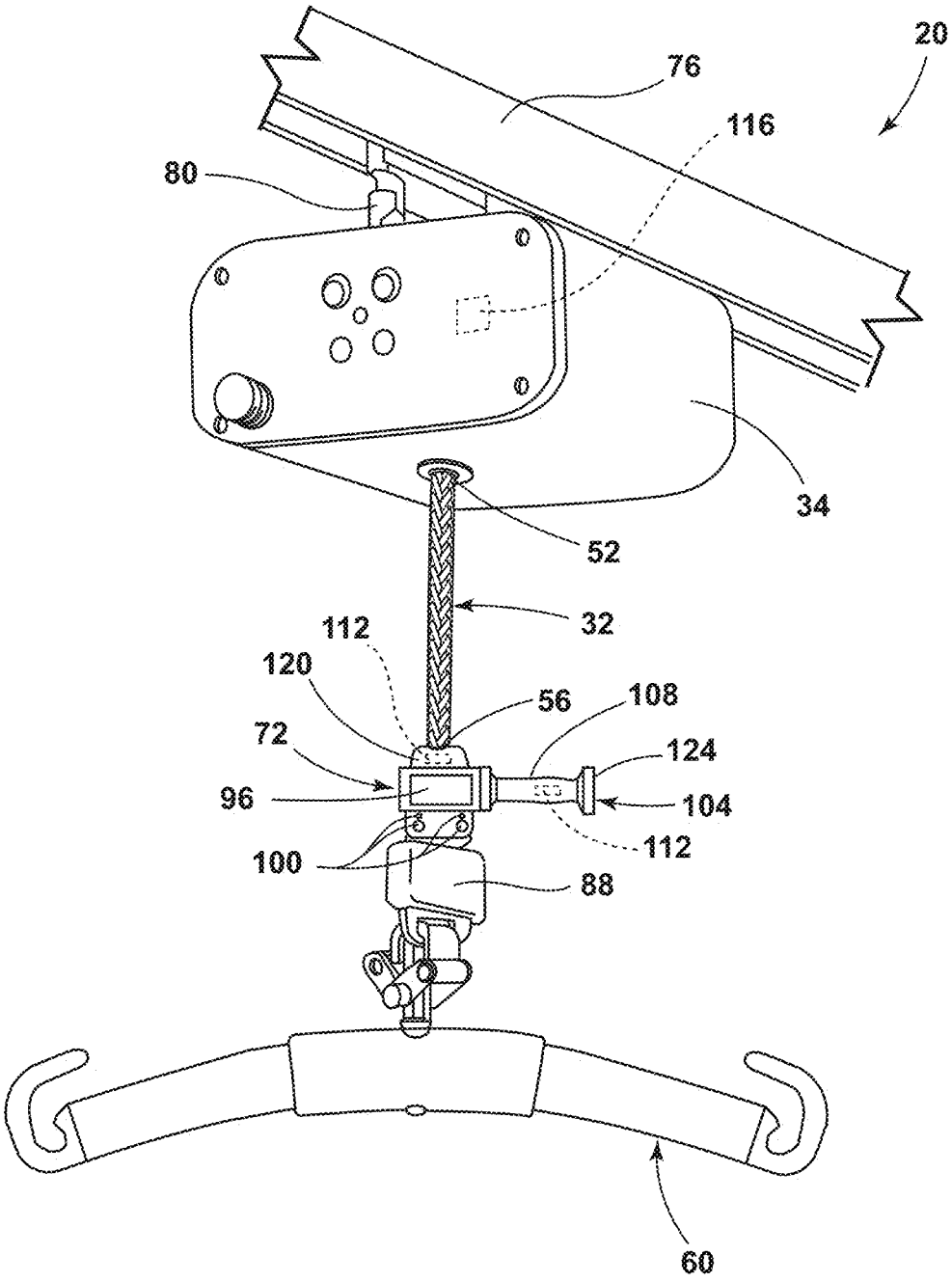
FIG. 4 is a perspective view of an exemplary rail-mounted patient lift system, illustrating a further example of the user interface.

Referring still further to FIGS. 1-4, in various examples, the user interface 72 can include a hand-actuated control assembly. In various examples, the hand-actuated control assembly can include a handle 104. The handle 104 can be positioned between the load-bearing member 32 and the coupler 88. In some examples, such as those shown in FIGS. 3 and 4, the handle 104 can be directly coupled between the coupler 88 and the display screen 96 (FIG. 3) or the display screen 96 can be directly coupled between the load-bearing member 32 and the coupler 88 with the handle 104 coupled to a lateral side of the display screen 96 (FIG. 4). In the example depicted in FIG. 3, the user can grasp a middle portion 108 of the handle 104 for vertical and/or horizontal actuation of the patient support assembly 60. Vertical actuation of the patient support assembly 60 can be accomplished by the user actuating the handle 104 in an upward direction or a downward direction, which can be sensed by one or more force sensors 112 that communicate the vertical actuation to a controller 116 that engages a raising of the patient support assembly 60 by retracting at least a portion of the load-bearing member 32 and/or the electrically conductive members 64 via rotation of the drum 28. The one or more force sensors 112 can be positioned in the user interface 72. For example, the one or more force sensors 112 can be positioned in the handle 104 of the user interface 72 and/or in a head 120 of the user interface 72. The region of the user interface 72 that supports the display screen 96 and/or the one or more buttons 100 can be referred to as the head 120 of the user interface 72.

In the depicted examples of FIGS. 3 and 4, a user (e.g., caregiver) can navigate between different modes, select various functions, input patient information, and the like by utilizing the one or more buttons 100 and referencing the display screen 96. To actuate the patient support assembly 60 in the vertical direction, the user can grasp the handle 104 and apply an upward or downward force to the handle 104, which is registered by the one or more force sensors 112. The one or more force sensors 112 can then communicate the magnitude and direction of the force applied to the handle 104 by the user to the controller 116. The controller 116 can then activate the motor 24 and initiate rotation of the drum 28 in the appropriate direction to facilitate raising or lowering of the patient support assembly 60 relative to the housing 34. Accordingly, the patient lift system 20 can be considered a force multiplier for the user such that the user can avoid overexertion and potential injury to themselves or the patient during the movement of the patient. In some examples, a zero-gravity or float mode may be selected by the user where the patient is suspended by the patient support assembly 60 and subsequent vertical and/or horizontal movement of the patient requires very little effort from the user. For example, once the patient is suspended by the patient support assembly 60, the zero-gravity or float mode may enable the user to accomplish further vertical and/or horizontal movement of the patient with a single finger applying pressure to the patient support assembly 60 or the user interface 72 in the desired direction of travel. In various examples, the user can exert a rotational force upon the patient support assembly 60 and/or the handle 104 to activate an aided rotation of the patient support assembly 60. For example, the user may grasp the handle 104 and exert a rotational force upon the handle 104, which is registered or sensed by the one or more force sensors 112. The force sensors 112 can communicate the sensed rotational force to the controller 116 and the controller 116 can initiate rotational movement of the patient support assembly 60 in the direction that is associated with the applied force. The magnitude of the applied force, regardless of the direction (e.g., vertical, horizontal, rotational), can be translated into a speed of movement in the direction of the applied force. In one specific example, the one or more force sensors 112 can include one or more potentiometers that measure a displacement from a rest or neutral position and provide displacement data that the controller 116 can interpret (e.g., via a processor) to initiate the requested or desired direction and/or speed of movement.

With reference to FIG. 4, the handle 104 of the user interface can be mounted to a lateral side of the head 120 of the user interface 72. It may be beneficial to provide the handle 104 in such an orientation to increase the degrees of freedom for movement of the handle 104, which can correspond to an increase in the number of movements that can be aided by the patient lift system 20. Additionally, movement of the handle 104 can be done in an intuitive way for horizontal and vertical movements of the patient support assembly 60. Further, the handle 104 can be actuated in vertical and horizontal directions without the user having to fully grasp the handle 104 with their hand. Accordingly, the user may be able to operate the patient lift system 20 from a further distance in the event that the patient being lifted or moved is particularly large (e.g., bariatric patients). For example, the user may actuate a free end 124 of the handle 104 in an upward direction to initiate a lifting of the patient support assembly 60, in a downward direction to initiate a lowering of the patient support assembly 60, in a horizontal fore or aft direction to initiate a corresponding movement of the patient support assembly 60 along the rails 76, and/or a rotational movement of the handle 104 relative to the head 120 of the user interface 72 to initiate rotational movement of the patient support assembly 60 about a vertical or horizontal axis. In some examples, the rotational movement of the handle 104 relative to the head 120 of the user interface 72 can initiate a raising of the patient support assembly 60 when rotated in one of a clockwise and a counter-clockwise direction and a lowering of the patient support assembly 60 when rotated in the other of the clockwise and the counter-clockwise direction.

Figure 5A:
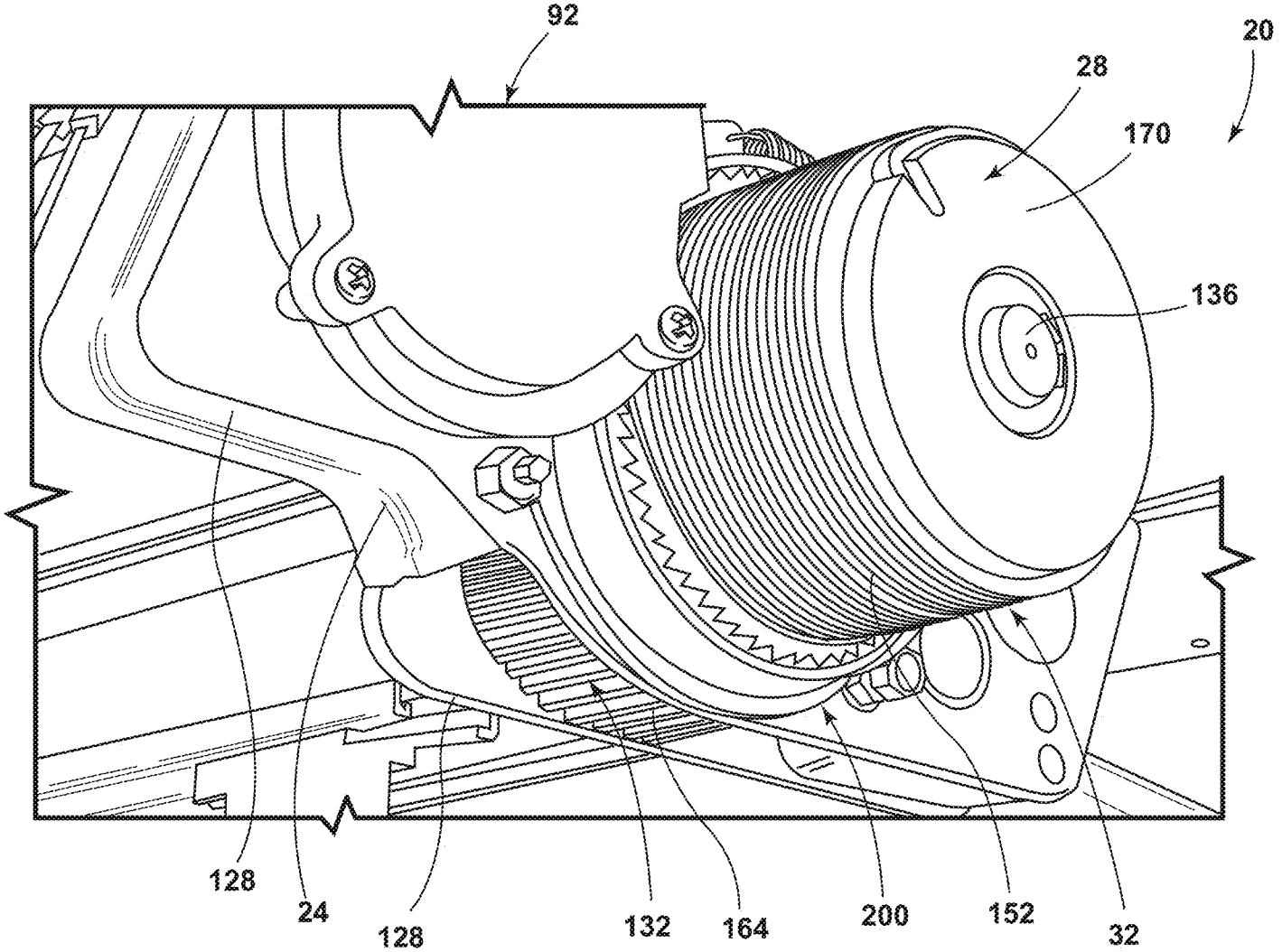
FIG. 5A is a side perspective view of a movement system of the patient lift system, according to one example.
Figure 5B:
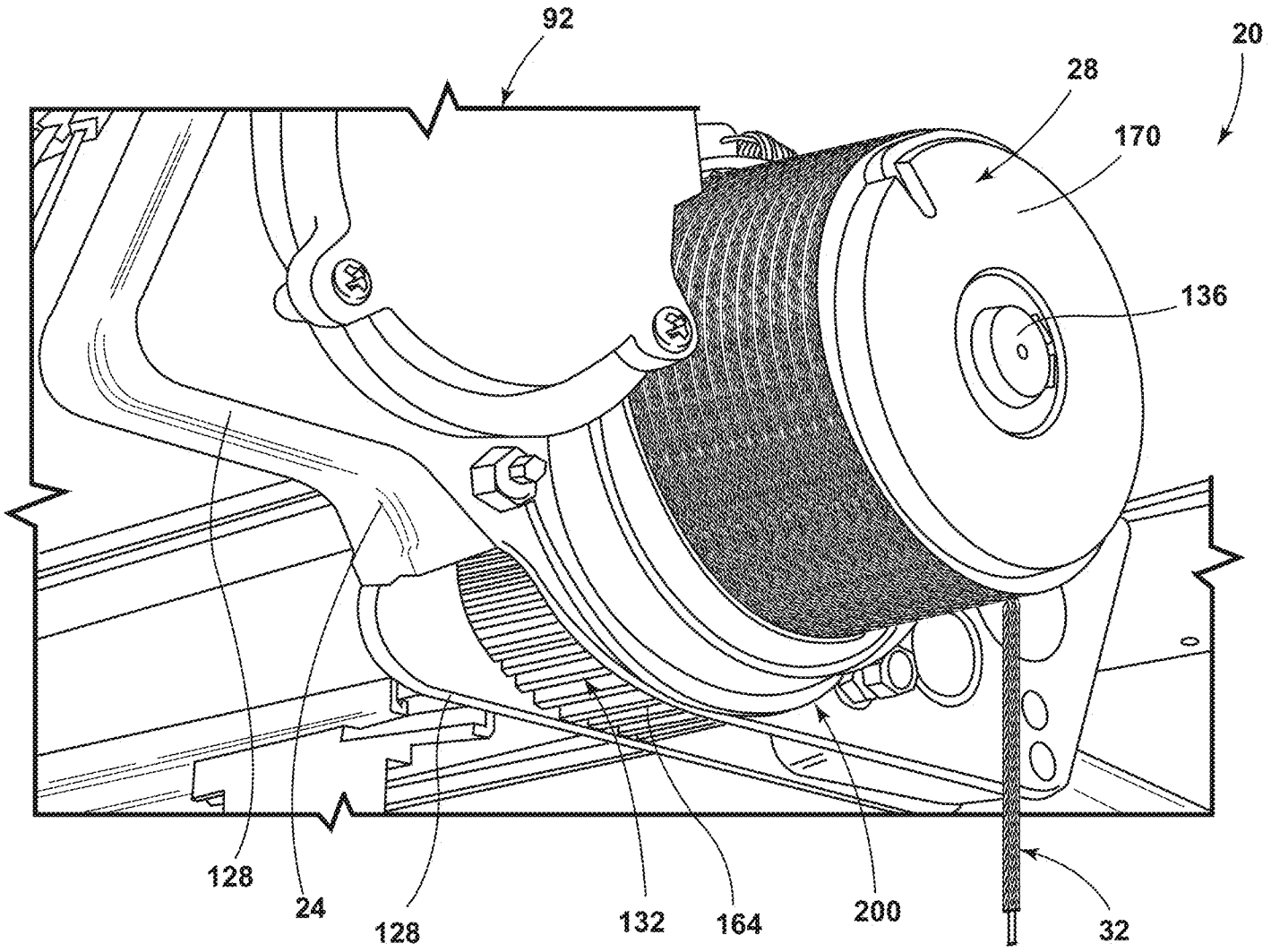
FIG. 5B is a side perspective view of a movement system of the patient lift system, illustrating a load-bearing member, according to one example.
Figure 6:
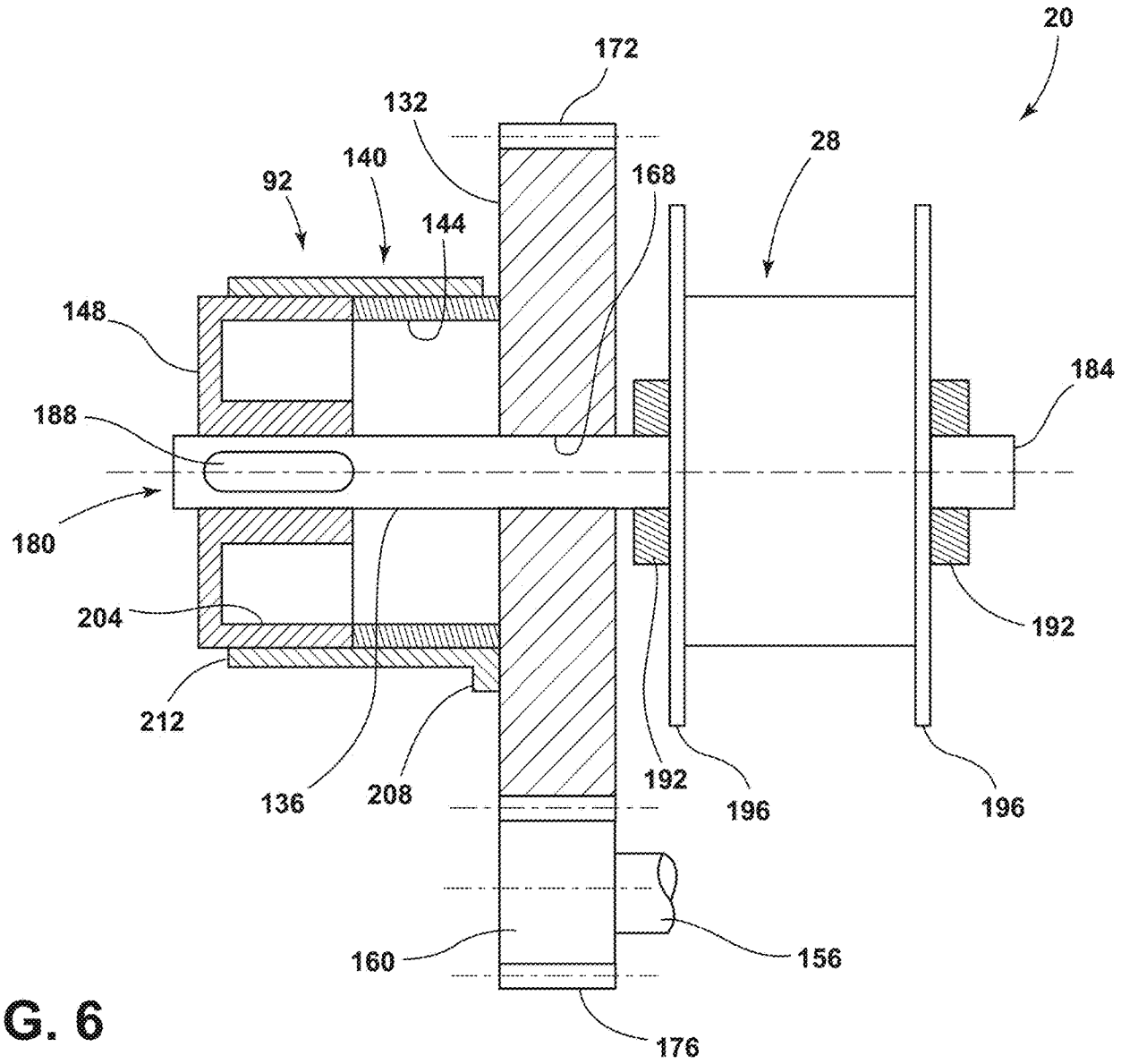
FIG. 6 is a partial sectional side view of a portion of the movement system of FIG. 5A.

Referring now to FIGS. 5A-6, the movement system 92 can be supported on one or more mounting plates 128 to facilitate coupling of the movement system 92 to at least one of the rails 76 and the housing 34. The movement system 92 includes the motor 24, the drum 28, a gear wheel 132, a shaft 136, and a brake or clutch system 140. A rotation axis of the drum 28 can be oriented along a horizontal axis. In one example, the gear wheel 132 is coupled to the drum 28 through a brake hub 144, a control hub 148, a wrap spring 152, and the shaft 136. In such an example, the gear wheel 132 may not be directly connected to the shaft 136 and is able to rotate with respect to the shaft 136. In alternative examples, the gear wheel 132 and the drum 28 are coupled to the shaft 136 to rotate with the shaft 136 as the shaft 136 is driven by the motor 24. The motor 24 includes a motor shaft 156 and a motor gear 160, as shown in FIG. 6, which is configured to engage the gear wheel 132. The motor shaft 156 passes through an opening in the mounting plates 128 to couple with the motor gear 160, which can be positioned between the mounting plates 128. In this example, the motor gear 160 is coupled to the motor shaft 156 to rotate with the motor shaft 156 as the motor shaft 156 is driven by the motor 24. The motor gear 160 meshes with or is otherwise operably coupled to the gear wheel 132 such that as the motor gear 160 rotates with the motor shaft 156, the rotation of the motor gear 160 causes the gear wheel 132 to rotate. As the gear wheel 132 rotates, the shaft 136 and drum 28 rotate and the load-bearing member 32 is paid-out or taken up (i.e., extended or retracted, respectively) in order to lower or raise the patient support assembly 60. The motor 24 can receive power from a battery housed within the patient lift system 20 or may be continually powered by one or more continuous power connections provided in the rails 76.

Referring again to FIGS. 5A-6, the gear wheel 132 is positioned between the mounting plates 128 and includes a motor-engaging portion 164, a shaft opening 168, and a brake-engaging portion, which may alternately be referred to as the brake hub 144. As shown in FIG. 6, the brake hub 144 is integrated with or formed as one piece with the gear wheel 132; however, in alternate examples, the brake hub 144 can be a separate piece that is coupled to the gear wheel 132 using a suitable fastener, such as one or more screws or bolts. The motor-engaging portion 164 includes gear teeth 172 that engage with gear teeth 176 on the motor gear 160.

The shaft opening 168 is generally concentrically aligned with the motor-engaging portion 164 and the brake hub 144 and allows the shaft 136 to pass therethrough and rotate with respect to the gear wheel 132. The brake hub 144 has a diameter that is smaller than a diameter of the motor-engaging portion 164 and extends from the motor-engaging portion 164 through an opening in the mounting plate 128. The brake hub 144 is generally cylindrical in shape and is configured to engage or operably couple to the brake or clutch system 140.

Referring further to FIGS. 5A-6, the shaft 136 extends through the shaft opening 168 in the gear wheel 132 and the opening in the mounting plate 128. The shaft 136 has a first end 180, an opposing second end 184, and a key slot 188 defined within or at the first end 180. The brake or clutch system 140 is operably coupled at or near the first end 180 and the drum 28 is operably coupled, such as directly coupled, at the second end 184. In this example, the brake or clutch system 140 is actuatable to stop and/or prevent the rotation of the shaft 136 and the drum 28. In some contemplated examples, the second end 184 can be coupled to a mounting structure to provide additional support for the drum 28 such that the drum 28 is positioned between the mounting plate 128 and the mounting structure. The drum 28 is separated from the mounting plate 128 by one or more bearings 192 and is configured to rotate in a clockwise or counter-clockwise rotational direction to extend or retract the load-bearing member 32. The drum 28 is generally cylindrical in shape and includes a pair of retaining flanges 196 at opposing ends of the drum 28. The load-bearing member 32 is wound around the drum 28 between the retaining flanges 196, which help maintain the load-bearing member 32 on the drum 28 as the drum 28 rotates to extend or retract the load-bearing member 32.

Referring still further to FIGS. 5A-6, the brake or clutch system 140 includes the control hub 148, the wrap spring 152 positioned about at least a portion of the control hub 148 and at least a portion of the brake hub 144, and an actuation mechanism 200. The control hub 148 is coupled to the shaft 136 by way of the key slot 188 and is configured to rotate with the shaft 136 and the drum 28. The control hub 148 is generally cylindrical and has a diameter that is substantially equal to a diameter of the brake hub 144. The wrap spring 152 is configured to frictionally engage with the control hub 148 and the brake hub 144 to stop and/or prevent the drum 28 from rotating with respect to the gear wheel 132. In various examples, the wrap spring 152 includes an end tang 204 and a control tang 208. The end tang 204 is retained in a slot 212 that is formed in the control hub 148 and the control tang 208 is engaged by the actuation mechanism 200, shown in FIG. 6. The control tang 208 is configured to engage with the gear wheel 132 to open the wrap spring 152 and expand the diameter of the wrap spring 152 in a radial direction with respect to a longitudinal axis of the shaft 136 to allow the shaft 136, the control hub 170, and the drum 28 to rotate with respect to the gear wheel 132. In this example, the wrap spring 152 expands in a radial direction to allow the wrap spring 152, the control hub 148, the shaft 136, and the drum 28 to rotate. Due to a load on the load-bearing member 32 always being in the same direction as a result of gravity, the wrap spring 152 can be biased toward remaining tight around the brake hub 144 and the control hub 148 regardless of whether the load-bearing member 32 is being extended or retracted. Moreover, the wrap spring 152 also works as a one-way clutch, preventing torque from being applied in an incorrect direction. In various examples, the load-bearing member 32 can be positioned or wrapped directly over the wrap spring 152. In such examples, the load-bearing member 32 can be sized such that the load-bearing member 32 is prevented from being pinched or snagged in the spaces between coils of the wrap spring 152 that can increase when the wrap spring 152 is expanded in the radial direction. Additionally, the load-bearing member 32 can be provided with a degree of stretch or flexibility that permits the wrap spring 152 to radially expand while maintaining the load-bearing member 32 in a tightly wrapped engagement with the drum 28 and/or the wrap spring 152. In some examples, the wrap spring 152 and the load-bearing member 32 can alternatively be separated by a spring housing that permits the radial expansion of the wrap spring 152 while maintaining the load-bearing member 32 as free of direct engagement with the wrap spring 152.

Figure 7:
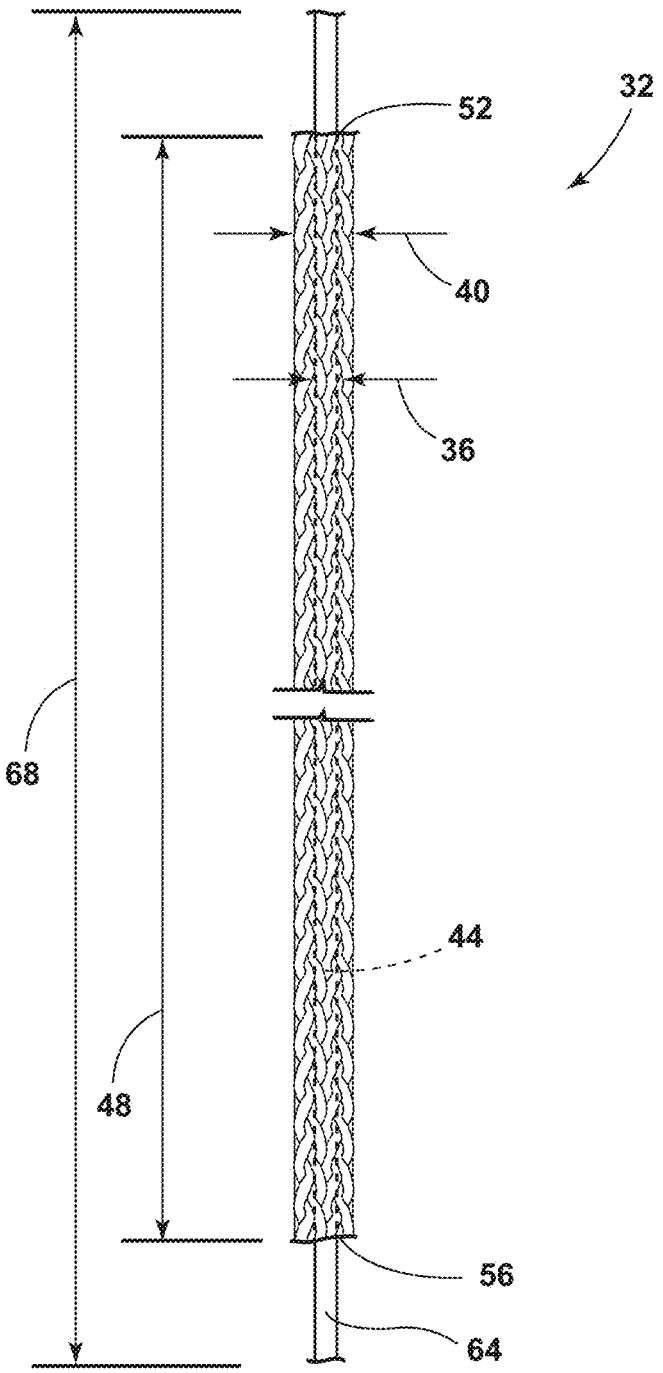
FIG. 7 is a front perspective view of the load-bearing member, illustrating an electrically conductive member passing therethrough, according to one example.

Referring to FIG. 7, the load-bearing member 32 can be made from a woven textile. For example, the woven textile can be made from an aramid fiber. In various examples, the load-bearing member 32 flexes or stretches in response to a load being applied to the patient support assembly 60 (FIG. 1). Accordingly, the patient that is supported by the patient support assembly 60 can be lifted with a soft-onset of tension rather than an abrupt transition that can be experienced when non-stretchable or non-flexible load-bearing members are employed. The soft-onset can also decrease the chances of damage to the patient lift system 20 (FIG. 1) by avoiding abrupt or jarring changes in forces experienced by the patient lift system 20. Therefore, wear and tear on the patient lift system 20 can be reduced. In various examples, the one or more electrically conductive members 64 are free to slide through the inner diameter 36 of the load-bearing member 32 such that the one or more electrically conductive members 64 are prevented from being damaged by the forces experienced by the patient support assembly 60 and the load-bearing member 32. Said another way, the load-bearing member 32 experiences, or takes, an entirety of the load or force imparted by normal use and operation of the patient support assembly 60 such that the electrically conductive members 64 do not experiences any stress associated with the load-bearing function of the load-bearing member 32. In some examples, the one or more electrically conductive members 64 are free of active engagement with the load-bearing member 32 when the load-bearing member 32 is in both a load-bearing and a non-load-bearing state. That is, the one or more electrically conductive members 64 can passively engage or contact the load-bearing member 32 in both the load-bearing and the non-load-bearing state without such contact with the load-bearing member 32 effecting the freedom of the one or more electrically conductive members 64 to move within the load-bearing member 32. As the load-bearing member 32 is placed under load (e.g., when lifting a patient) the load-bearing member 32 stretches or is elongated such that the inner diameter 36 of the load-bearing member 32 decreases and approaches the one or more electrically conductive members 64. However, while the inner diameter 36 decreases, a minimum of the inner diameter 36 is configured to be at least equal to an outer diameter of the one or more electrically conductive members 64 such that the one or more electrically conductive members 64 are prevented from bearing any load. It may be beneficial for the minimum of the inner diameter 36 to be greater than the outer diameter of the one or more electrically conductive members 64 to further ensure that the one or more electrically conductive members 64 are prevented from bearing any load and the one or more electrically conductive members 64 maintain their freedom of movement within the load-bearing member 32.

Referring again to FIG. 7, in alternative examples, the load-bearing member 32 can be provided as a strap or generally flat and narrow woven textile rather than as a generally round or tubular construction. However, the concepts described above with regard to various features and examples of the load-bearing member 32 may apply in whole or in part to the alternative examples of the load-bearing member 32 where a strap or generally flat and narrow woven textile is employed. For example, when the load-bearing member 32 is provided as a generally flat and narrow woven textile, the load-bearing member 32 may omit the inner diameter 36 such that the load-bearing member 32 is provided with material in a center of the load-bearing member 32 rather than being provided with the aperture 44. In such an example, the one or more electrically conductive members 64 can be woven into the load-bearing member 32 or the load-bearing member 32 may be constructed of a conductive textile or conductive yarn. The electrically conductive members 64, when integrally woven with the load-bearing member 32, can be utilized as described above for transmitting power and/or data while optionally also providing an indication of a wear status or fatigue of the load-bearing member 32. For example, the electrically conductive members 64 can include wear sensors (e.g., resistive wires) that provide an indication of a change in a measured signal that can be interpreted by the controller 116 to correlate with a degree of fatigue or wear of the load-bearing member 32. In some examples, when the generally flat and narrow woven textile is utilized as the load-bearing member 32, the aperture 44 defined by the inner diameter 36 can be maintained such that the one or more electrically conductive members 64 can be provided in the aperture 44. Such an arrangement, where the aperture 44 is provided in a generally flat and narrow woven textile, may be beneficial in preventing the electrically conductive members 64 from becoming tangled or otherwise poorly aligned within the aperture 44 as the electrically conductive members 64 may be arranged side-by-side and maintained in such an arrangement as the load-bearing member 32 is paid out or taken up. In various examples, the generally flat and narrow woven textile may be utilized as the load-bearing member 32 with one or more integrally woven electrically conductive members 64 and one or more electrically conductive members 64 provided in the aperture 44 defined by the inner diameter 36. For example, power and/or data cables may be provided in the aperture 44 while wear sensors are provided as integrally woven with the load-bearing member 32 (e.g., resistive wires). Accordingly, the load-bearing member 32 may be replaced once a predetermined wear threshold is reached while the power and/or data cables remain and can be inserted into a new load-bearing member 32. Therefore, consumable costs may be decreased when compared to load-bearing members 32 that are integrally woven with the power and/or data cables. In various examples, one or more emergency support cables or wires may be provided as integrally woven with the load-bearing member 32 and/or within the aperture 44. The emergency support cable or wire can serve as an emergency support in the event of a catastrophic failure of the load-bearing member 32 such that a patient supported by the load-bearing member 32 is prevented from free-falling to the ground and potentially causing injury.

Some patient lifting assemblies utilize load-bearing members (e.g., lift straps) that are provided with dedicated control units, such as hand controls, that are poorly integrated into the overall patient lifting assemblies. In particular, it has been a challenge to develop a user-friendly way of stowing the hand control while maintaining the best possible patient experience and care. An additional challenge has been the development of a control unit that can be utilized across an entire product portfolio. Accordingly, the present disclosure provides a well-integrated patient lift system 20 that is provided with a user interface 72 that focuses on ease-of-use, ease-of-access, improved patient experience, and that can be utilized across a large cross-section or an entirety of a product portfolio. Additionally, some patient lifting assemblies are configured to wind or wrap their load-bearing member (e.g., lift strap) up into a vertical stack, which causes the drum and the orientation of the load-bearing member to dictate the vertical profile of the patient lifting assembly as well as limiting the height a patient can be lifted. As working loads increase, say to hundreds of kilograms, the thickness of a lifting strap must increase, thereby further increasing the overall profile of the patient lifting assembly and further decreasing the maximum height that a patient can be lifted. Accordingly, the profile of the patient lift system 20 of the present disclosure can be contained in a horizontal plane such that a narrower profile is provided that does not negatively affect the maximum lift height of the patient lift system 20. The present disclosure provides the patient lift system 20 with an elegant and well-integrated solution to at least these problems.

Modifications of the disclosure will occur to those skilled in the art and to those who make or use the concepts disclosed herein. Therefore, it is understood that the embodiments shown in the drawings and described above are merely for illustrative purposes and not intended to limit the scope of the disclosure, which is defined by the following claims as interpreted according to the principles of patent law, including the doctrine of equivalents.

It will be understood by one having ordinary skill in the art that construction of the described concepts, and other components, is not limited to any specific material. Other exemplary embodiments of the concepts disclosed herein may be formed from a wide variety of materials, unless described otherwise herein.

For purposes of this disclosure, the term "coupled" (in all of its forms: couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature, or may be removable or releasable in nature, unless otherwise stated.

It is also important to note that the construction and arrangement of the elements of the disclosure, as shown in the exemplary embodiments, is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts, or elements shown as multiple parts may be integrally formed, the operation of the interfaces may be reversed or otherwise varied, the length or width of the structures and/or members or connector or other elements of the system may be varied, and the nature or numeral of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes, or steps within described processes, may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present disclosure, and further, it is to be understood that such concepts are intended to be covered by the following claims, unless these claims, by their language, expressly state otherwise.

What is claimed is:

1. A patient lift system, comprising:

a motor;

a drum operably coupled to the motor, the drum being selectively driven to rotate by the motor;

a housing that surrounds at least the motor and the drum;

a load-bearing member having a first end and a second end, the first end of the load-bearing member being operably coupled to at least one of the housing and the drum, the second end of the load-bearing member being operably coupled to a patient support assembly, wherein the load-bearing member includes an inner diameter and an outer diameter, and wherein the inner diameter defines an aperture that extends along an entirety of a length of the load-bearing member;

an electrically conductive member positioned within the aperture defined by the inner diameter of the load-bearing member;

a user interface configured to actuate the patient support assembly in vertical and horizontal directions; and a force sensor configured to sense a magnitude of force applied in at least one of the vertical direction and the horizontal direction, wherein the sensed magnitude of force is converted into corresponding translational motion of the patient support assembly in at least one of the vertical direction and the horizontal direction.

2. The patient lift system of claim 1, wherein the load-bearing member is directly and statically coupled to the housing such that the electrically conductive member passes through the load-bearing member as the electrically conductive member is wound and unwound from the drum.

3. The patient lift system of claim 1, wherein the load-bearing member is directly coupled to the drum such that the load-bearing member and the electrically conductive member are wound and unwound from the drum as the patient support assembly is extended and retracted relative to the housing.

4. The patient lift system of claim 1, wherein the user interface includes a button, and wherein upon actuation of the button on the user interface, actuation of the patient support assembly in the horizontal direction is initiated.

5. The patient lift system of claim 1, wherein the force sensor is coupled to the user interface.

6. The patient lift system of claim 1, wherein the user interface includes a hand-actuated control assembly.

7. The patient lift system of claim 1, further comprising:

a carriage that extends from the housing to slidably couple said patient lift system to a rail, wherein the rail guides said patient lift system during actuation of the patient support assembly in the horizontal direction.

8. A patient lift system, comprising:

a motor;

a drum operably coupled to the motor, the drum being selectively driven to rotate by the motor;

a housing that surrounds at least the motor and the drum;

a load-bearing member having a first end and a second end, the first end of the load-bearing member being operably coupled to at least one of the housing and the drum, the second end of the load-bearing member being operably coupled to a patient support assembly, wherein the load-bearing member is a woven textile;

an electrically conductive member integrally woven with the load-bearing member;

a user interface configured to actuate the patient support assembly in vertical and horizontal directions; and a force sensor configured to sense a magnitude of force applied in at least one of the vertical direction and the horizontal direction, wherein the sensed magnitude of force is converted into corresponding translational motion of the patient support assembly in at least one of the vertical direction and the horizontal direction.

9. The patient lift system of claim 8, wherein the load-bearing member is directly and statically coupled to the housing such that the electrically conductive member passes through the load-bearing member as the electrically conductive member is wound and unwound from the drum.

10. The patient lift system of claim 8, wherein the load-bearing member is directly coupled to the drum such that the load-bearing member and the electrically conductive member are wound and unwound from the drum as the patient support assembly is extended and retracted relative to the housing.

11. The patient lift system of claim 8, wherein the user interface includes a button, and wherein upon actuation of the button on the user interface, actuation of the patient support assembly in the horizontal direction is initiated.

12. The patient lift system of claim 8, wherein the force sensor is coupled to the user interface.

13. The patient lift system of claim 8, wherein the user interface comprises a hand-actuated control assembly.

14. The patient lift system of claim 8, further comprising:

a carriage that extends from the housing to slidably couple said patient lift system to a rail, wherein the rail guides said patient lift system during actuation of the patient support assembly in the horizontal direction.

15. A patient lift system, comprising:

a motor;

a drum operably coupled to the motor, the drum being selectively driven to rotate by the motor;

a housing that surrounds at least the motor and the drum;

a load-bearing member having a first end and a second end, the first end of the load-bearing member being operably coupled to at least one of the housing and the drum, the second end of the load-bearing member being operably coupled to a patient support assembly;

an electrically conductive member extending along a length of the load-bearing member; and a user interface configured to actuate the patient support assembly in vertical and horizontal directions, the user interface including a force sensor configured to sense a magnitude of force applied in at least one of the vertical direction and the horizontal direction, wherein the sensed magnitude of force is converted into corresponding translational motion of the patient support assembly in at least one of the vertical direction and the horizontal direction.

16. The patient lift system of claim 15, further comprising:

a carriage that extends from the housing to slidably couple said patient lift system to a rail, wherein the rail guides said patient lift system during actuation of the patient support assembly in the horizontal direction.

* * * * *